US010165872B2

(12) United States Patent
Jones et al.

(10) Patent No.: US 10,165,872 B2
(45) Date of Patent: Jan. 1, 2019

(54) PANEL ASSEMBLY, PANEL SYSTEM INCLUDING THE PANEL ASSEMBLY, AND METHOD THEREOF

(71) Applicant: THINKTERIOR STUDIO PTE. LTD., Ngee Ann (SG)

(72) Inventors: Christopher D. Jones, Ashburn, VA (US); Anthony M Hughes, Bangkok (TH); Matthew D. Thorpe, Johor (MY)

(73) Assignee: THINKTERIOR STUDIO PTE. LTD., Ngee Ann (SG)

( * ) Notice: Subject to any disclaimer, the term of this patent is extended or adjusted under 35 U.S.C. 154(b) by 140 days.

(21) Appl. No.: 15/215,945

(22) Filed: Jul. 21, 2016

(65) Prior Publication Data

US 2018/0020849 A1 Jan. 25, 2018

(51) Int. Cl.
*A47F 5/08* (2006.01)

(52) U.S. Cl.
CPC ..... *A47F 5/0823* (2013.01); *A47F 5/0815* (2013.01)

(58) Field of Classification Search
CPC ..... A47F 5/0815; A47F 5/0823; A47F 5/00; A47F 5/0846; A47F 5/08; A47F 5/0807; A47F 5/083
USPC ..... 248/220.31, 220.41, 220.42; 211/87.01, 211/189, 175, 106.01, 162, 46, 94.01, 211/105.1, 113, 118, 59.1, 57.1, 54.1; 108/152
See application file for complete search history.

(56) References Cited

U.S. PATENT DOCUMENTS

RE18,604 E 9/1932 Cox et al.
2,100,421 A * 11/1937 Wupper ..... A63F 3/00574 235/90
3,497,079 A 2/1970 Kulwiec
4,026,415 A * 5/1977 Sarley ..... A47F 3/002 211/4
4,204,665 A 5/1980 Sherwood
4,461,443 A 7/1984 Dauman
4,467,990 A 8/1984 Wiseman
4,685,263 A 8/1987 Ting
4,780,349 A 10/1988 Gieske et al.
4,932,538 A 6/1990 Gambello
4,951,827 A * 8/1990 Moransais ..... A47F 5/10 211/194
5,073,070 A 12/1991 Chang
5,201,242 A 4/1993 Chi
(Continued)

OTHER PUBLICATIONS

US 5,309,158, 10/2001, Bellinghausen et al. (withdrawn)

*Primary Examiner* — Hiwot E Tefera
(74) *Attorney, Agent, or Firm* — Rossi, Kimms & McDowell LLP

(57) ABSTRACT

A panel assembly, system, and method include upper and lower panels attached respectively to upper and lower back support, which are connectable to each other using linking beams. The upper back support is configured to be hung from a horizontal beam. The panels have through holes and the back supports have front blind holes that are aligned with the through holes in the panels. In another embodiment, rear blind holes are also provided in the back supports. A peg is securable to each of the blind holes. Multiple pegs can be secured to provide furniture options that can be used for storing, displaying, organizing, and merchandizing. Rear blind holes provides additional storage that can be hidden away from view.

20 Claims, 12 Drawing Sheets

(56) References Cited

U.S. PATENT DOCUMENTS 5,207,545 A 5/1993 Kochanski
5,239,798 A * 8/1993 Saito ..... E04B 2/92 52/235
5,267,480 A 12/1993 Krizan
5,340,258 A 8/1994 Simon
5,379,561 A 1/1995 Saito
5,582,116 A * 12/1996 Spimpolo ..... A47B 96/00 108/108
5,680,798 A 10/1997 Luen
5,785,187 A * 7/1998 Lipman ..... A47F 5/0815 211/54.1
5,785,190 A * 7/1998 Otema ..... A47F 5/0823 211/103
5,787,675 A 8/1998 Futagi
6,526,789 B1 3/2003 Edgerly et al.
7,197,806 B2 * 4/2007 Boudreaux ..... F16B 5/02 29/434
7,415,741 B1 8/2008 Wasley et al.
7,424,958 B1 * 9/2008 Eley ..... B25H 3/04 211/70.6
7,481,406 B2 * 1/2009 Lang ..... A47F 5/0815 248/220.31
7,530,645 B2 5/2009 Takachi
7,628,416 B2 12/2009 Hara
7,788,860 B2 9/2010 Bartman et al.
7,798,338 B2 9/2010 Maheu et al.
7,845,501 B1 12/2010 Fosburg et al.
7,954,653 B2 6/2011 Adams et al.
7,963,621 B1 6/2011 Ellis
8,037,642 B2 * 10/2011 Nagel ..... A47B 83/001 211/87.01
8,114,077 B2 2/2012 Steiner et al.
8,266,849 B2 9/2012 Bravo et al.
8,360,254 B2 1/2013 Topping et al.
8,511,023 B1 8/2013 Gulbrandsen et al.
8,641,714 B2 2/2014 Steiner et al.
8,696,229 B2 4/2014 Tran
8,770,416 B1 7/2014 Guida
8,827,089 B2 * 9/2014 Stukenberg ..... A47F 5/0815 211/103
9,003,629 B2 4/2015 Topping et al.
9,032,682 B2 5/2015 Knoll et al.
9,149,115 B2 * 10/2015 Kasza ..... A47B 73/00
9,151,044 B2 10/2015 Krapf et al.
9,163,415 B2 10/2015 Nies
9,550,292 B1 * 1/2017 Putila ..... B25H 3/04
2003/0006681 A1 * 1/2003 Herron, III ..... A47B 57/42 312/245
2004/0156676 A1 8/2004 Boudreaux et al.
2007/0057133 A1 3/2007 Cottingham
2007/0141946 A1 6/2007 Sorensen et al.
2008/0257840 A1 10/2008 Eley
2009/0108156 A1 4/2009 Lang et al.
2013/0081249 A1 * 4/2013 McLean ..... A47F 5/0846 29/428
2013/0133169 A1 5/2013 Topping et al.
2014/0096363 A1 4/2014 Khamithar et al.
2015/0191914 A1 7/2015 Biterman
2015/0216329 A1 8/2015 Topping et al.
2015/0335177 A1 * 11/2015 Goodwin ..... A47F 5/0838 211/41.1
2016/0029790 A1 * 2/2016 Carpenter ..... A47F 5/0815 211/75

* cited by examiner

PANEL ASSEMBLY, PANEL SYSTEM INCLUDING THE PANEL ASSEMBLY, AND METHOD THEREOF

BACKGROUND

Walls are typically useful for hanging items, including display boards and certain furniture. As noted in U.S. Pat. No. 7,481,406, display wall panels, such as pegboards are well known. Pegboards have many uses, including displaying merchandize, storing tools along a wall without contacting the finished wall behind the pegboard. This patent uses interlocking modular pegboards that can be directly mounted to a wall by providing a clearance behind the panel to allow for insertion of a hook. U.S. Pat. No. 4,932,538 also discloses a similar modular pegboard that is directly mounted to a wall.

U.S. Pat. No. 7,798,338 discloses another pegboard application, where multiple display modules are mechanically linked using interlocking connectors, and hung from either conventional pegboards or slatwall using a universal mounting bracket.

U.S. Pat. No. 7,963,621 further discloses that pegboards are typically secured to a front face of wall studs or free standing vertical supports, such as contained in rolling and floor-mounted cabinets. Conventional pegboards require sufficient back clearance to allow mounting of hanging hooks or brackets for hanging, for examples, tools.

U.S. Pat. Nos. 3,497,079 and 4,461,443 further disclose a box-type support structure for a pegboard to allow for improved stability or weight carrying capability.

One known wall-mountable furniture uses a French cleat system. See for example, U.S. Pat. Nos. 4,780,349 and 7,954,653, which disclose opposed complementary cleats with angled mating ends. One cleat is secured to a support wall and the other cleat having a similar configuration, inverted in relation to the one cleat, is attached to the back of a cabinet. The cleat secured to the wall is a horizontal beam with an angled mating end that angles down toward the wall to draw the cabinet and the cleats into abutting engagement with the wall. That is, the shorter side of the wall cleat confronts the wall, while the shorter side of the cabinet cleat confronts the cabinet.

Another example, as disclosed in U.S. Pat. No. 3,381,636, uses a French cleat system for a shelving application. A wall cleat configured as a horizontal beam is secured to a wall. This cleat has a cut-out at the upper side that confronts the wall, forming an upwardly facing groove when mounted to the wall. The end of the shelf has a downwardly facing mating end that sits on the wall cleat.

There still remains a need for a wall system that can be easily adopted in homes and offices, as well as for shop use, namely to display merchandize, while providing appealing appearance. The present development addresses this need.

SUMMARY

One aspect of the present development is a panel assembly. The panel assembly is hangable on a hanging horizontal beam mounted to a structural support and usable with at least one peg to display an object. The panel assembly includes a first panel and a first back support. The first panel has a front side and a back side, and a plurality of spaced first through holes extending between the front side and the back side. Each of the plurality of first through holes is dimensioned to permit the peg to pass therethrough.

The first back support has a first side and a second side opposite the first side, and is secured to the back side of the first panel with the first side of the first back support confronting the back side of the first panel. The first back support includes, on the first side, a plurality of first blind holes that each align with one of the plurality of first through holes, and is configured engage and hang from the hanging horizontal beam. Each of the plurality of first blind holes is dimensioned to receive the peg inserted through one of the plurality of first through holes. The first back support can also include, on the second side, a plurality of back blind holes each configured to receive the peg inserted from the second side.

The panel assembly can include a second panel and a second back support. The second panel is disposable below the first panel. The second panel has a front side and a back side, and a plurality of spaced second through holes extending between the front side and the back side thereof. The second back support has a first side and a second side opposite the first side thereof, and is secured to the back side of the second panel with the first side of the second back support confronting the back side of the second panel. The second back support includes, on the first side thereof, a plurality of second blind holes that each align with one of the plurality of second through holes. Each of the plurality of second through holes is dimensioned to permit the peg to pass therethrough. Each of the plurality of second blind holes is dimensioned to receive the peg inserted through one of the plurality of second through holes. The plurality of first through holes and the plurality of second through holes can be arrayed.

The first back support includes a plurality of first vertical beams and a first horizontal beam. Each of the plurality of first vertical beams has a first side disposed confronting the back side of the first panel and a second side opposite the first side thereof. The plurality of first vertical beams are horizontally spaced from each other. The first horizontal beam having a first side disposed confronting the back side of the first panel and a second side opposite the first side thereof.

Each of the plurality of first vertical beams has, on the first side thereof, a first slot sized to receive the first horizontal beam and allow the first side of the first horizontal beam and the first sides of the plurality of first vertical beams to contact the back side of the first panel. Each of the plurality of first vertical beams has, on the second side, a second slot configured to hook onto an upper portion of the hanging horizontal beam. Each of the first vertical beams has a plurality of vertically spaced first blind holes opening from the first side thereof. The plurality of first blind holes in the first back support correspond to the plurality of vertically spaced first blind holes in the plurality of first vertical beams.

The second back support includes a plurality of second vertical beams and a second horizontal beam. Each of the plurality of second vertical beams has a first side disposed confronting the back side of the second panel and a second side opposite the first side thereof. The plurality of second vertical beams are horizontally spaced from each other. The second horizontal beam has a first side disposed confronting the back side of the second panel and a second side opposite the first side thereof.

Each of the plurality of second vertical beams has, on the first side thereof, a second slot sized to receive the second horizontal beam and allow the first side of the second horizontal beam and the first sides of the plurality of second vertical beams to contact the back side of the second panel.

Each of the second vertical beams has a plurality of vertically spaced second blind holes opening from the first side thereof. The plurality of second blind holes in the second back support correspond to the plurality of vertically spaced second blind holes in the plurality of second vertical beams.

The second back support also includes a third horizontal beam having a first side disposed confronting the back side of the second panel and a second side opposite the first side thereof. Each of the plurality of second vertical beams has a third slot vertically spaced from the second slot and sized to receive the third horizontal beam and allow the first side of the third horizontal beam and the first sides of the plurality of second vertical beams to contact the back side of the second panel.

The panel assembly further includes first and second linking beams that secure together the first and second back supports. The first linking beam secures one of the plurality of first vertical beams and one of the plurality of second vertical beams and the second linking beam secures together another of the plurality of first vertical beams and another of the plurality of second vertical beams. A plurality of fasteners can secure the first linking beam to the one first vertical beam and the one second vertical beam, and the second linking beam to the another first vertical beam and the another second vertical beam.

The vertical length of each of the plurality of first vertical beams can be substantially equal to the vertical length of the first panel. The vertical length of each of the plurality of second vertical beams can be substantially shorter than the vertical length of the second panel.

Each of the first horizontal beam and the plurality of the first vertical beams can be secured to the back side of the first panel with an adhesive. The first horizontal beam and the plurality of the first vertical beams can be secured together with the adhesive. Each of the second and third horizontal beams and the plurality of the second vertical beams can be secured to the back side of the second panel using the adhesive. The second and third horizontal beams and the plurality of the second vertical beams can be secured together with the adhesive.

The locking peg includes a bolt with a threaded shaft, a tubular member having a first end and a second end, and a wedge configured to be engageable with the second end of the tubular member and having a threading configured to receive the thread shaft inserted into the tubular member from the first end. Drawing the wedge against the second end of the tubular member by rotating the bolt in one direction secures the locking peg to the first or blind hole in the first back support or one of the back blind holes.

Another aspect of the present development is a panel system. The panel system includes the hanging horizontal beam that is mountable to a structural support, at least one locking peg, and the panel assembly that is hangable on the hanging horizontal beam. The first back support and the hanging horizontal beam are complementarily configured so that the hanging horizontal beam is engageable with the first back support.

The locking peg securable to the first back support using one of the plurality of first or second or back blind holes. The locking peg has a locking mechanism at one end and is configured to extend through a first or second through hole, among the plurality of first or second through holes, and extend into and secure to a first or second blind hole, among the plurality of first or second blind holes, aligned with the first or second through hole. The locking peg is configured to extend outwardly from the front side of the first or panel when fully seated in the first or second blind hole.

Another aspect of the present development is a method of assembling and hanging the panel assembly. The method includes the steps of providing the first and second linking beams, providing the hanging horizontal beam, mounting the hanging horizontal beam to a structural support, securing together the upper and lower back support using the first and second linking beams, and hanging the assembled panel assembly on the hanging horizontal beam.

DETAILED DESCRIPTION

The present panel assembly PA, which is designed to be flexible, can provide individuals and families with storage and furniture options that maximize smaller living spaces and provide the opportunity to be creative. Other useful feature is that the present panel assembly also can be used for displaying, organizing, and storing merchandise, such as at exhibits or trade shows. There are many uses for the present panel assembly since it can be disassembled for portability and quickly assembled.

Figure 12:
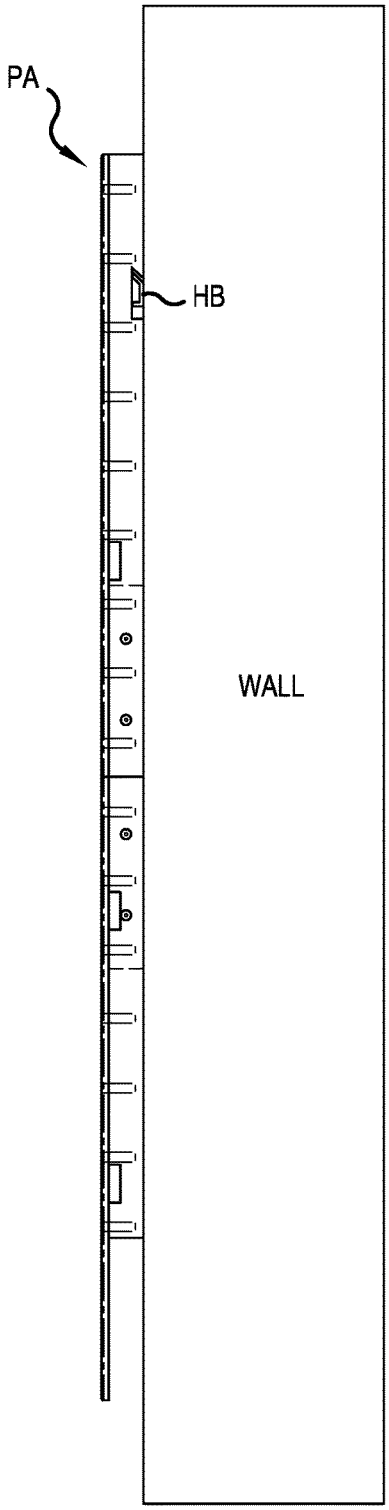
FIG. 12 illustrates the side view of the first embodiment (see FIG. 4) hung from the wall.
Figure 13:
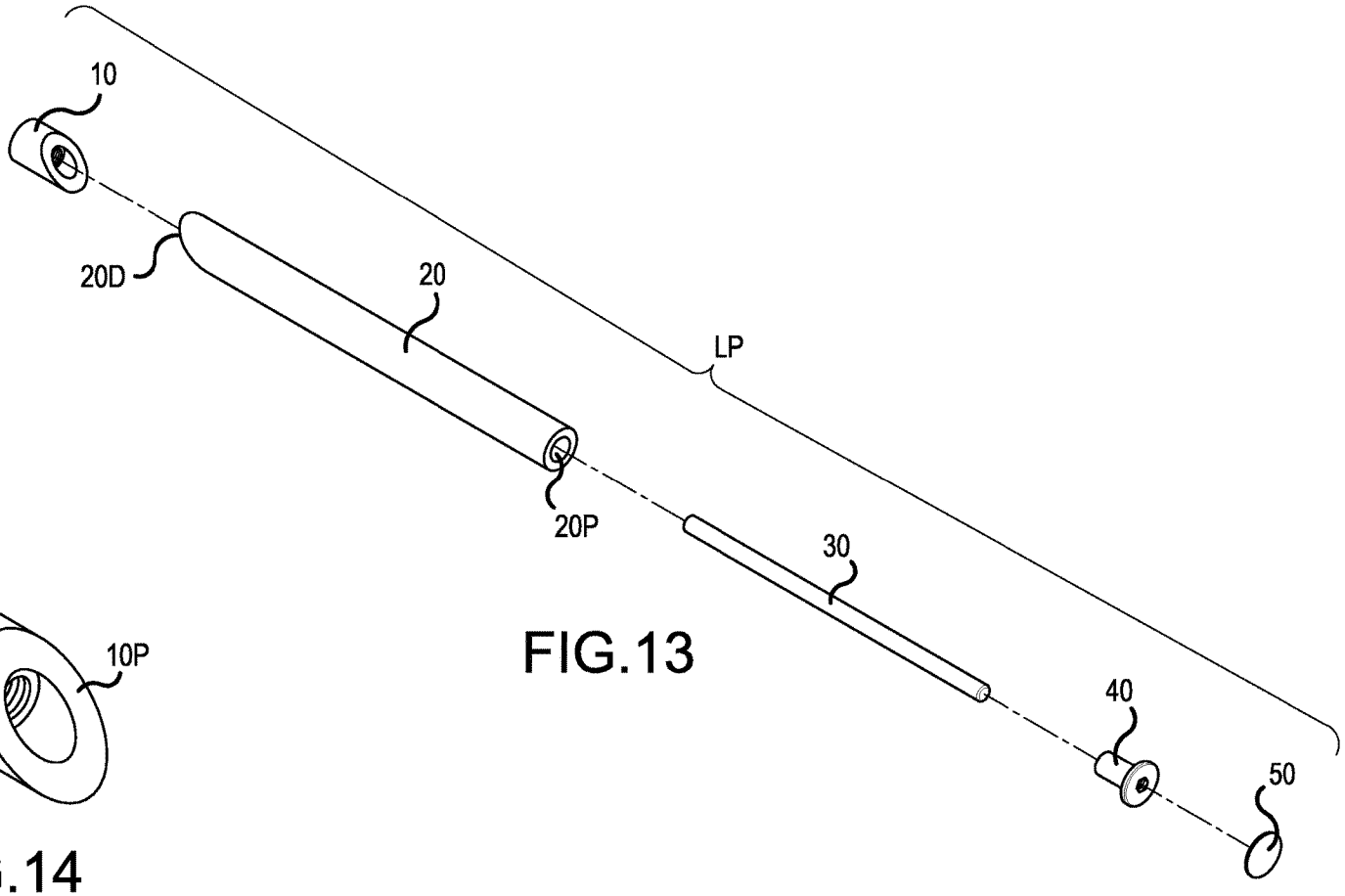
FIG. 13 illustrates an exploded perspective view of the present locking peg.
Figure 14:
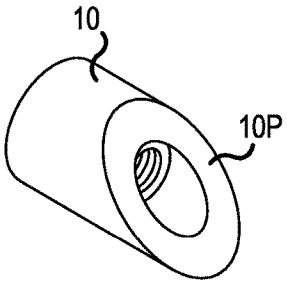
FIG. 14 illustrates an enlarged view of a wedge of the locking peg.
Figure 15:
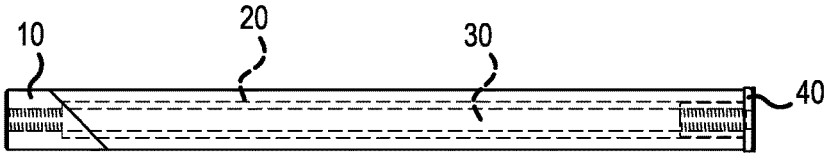
FIG. 15 illustrates the side view (in relation to FIG. 13) of the locking peg.
Figure 16:
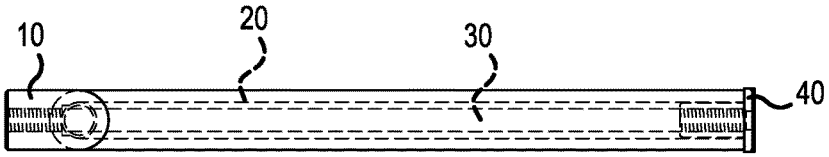
FIG. 16 illustrates the bottom view (in relation to FIG. 13) of the locking peg.
Figure 17:
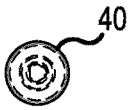
FIG. 17 illustrates the right end view (in relation to FIG. 13) of the locking peg.

The panel assembly PA is hangable from a hanging horizontal beam HB (hereafter hanging beam) that is held securely to a structural support, such as a wall, stand, frame, etc., using fasteners. The hanging beam HB is horizontally mounted to a wall and can be made of metal. FIG. 12 illustrates the present panel assembly PA hung on a vertical wall using the hanging beam HB that has a French-cleat configuration that allows the weight (gravity) of the item to be mounted to securely hold the panel assembly in place.

The back side of the panel support (disclosed below in detail) is used for mounting the panel assembly to the hanging beam HB.

The panel assembly PA includes an upper (first) panel 1, a lower (second) panel 2, an upper (first) back support (3, 5) secured to the upper panel 1, a lower (second) back support (4, 5) secured to the lower panel 2, and linking vertical beams 7 that connect together the upper and lower back supports using fasteners 9, which can be bolts each provided with a threaded shaft.

Each of the upper and lower panels 1, 2, which can be flat, has a front side (see FIG. 1) and a back side (see FIG. 2), and a plurality of spaced (first, second) through holes 1H, 2H extending between the front side and the back side. The through holes 1H, 2H can be in an array configuration as illustrated, namely having a predetermined number of horizontally spaced through holes arranged along each of a plurality of vertically spaced rows and a predetermined number of vertically spaced through holes along each of a plurality of horizontally spaced columns. In the illustrated embodiment, the upper panel 1 has nine rows and five columns of through holes, thus providing 45 through holes 1H, and the lower panel 2 has seven rows and five columns of through holes 2H, thus providing 35 through holes that are aligned with the through holes 1H along the five columns. The number of through holes, however, are not critical. Moreover, while the illustration shows the through holes being arranged in an array, the through holes can be arranged in a different pattern or offset pattern.

Figure 1:
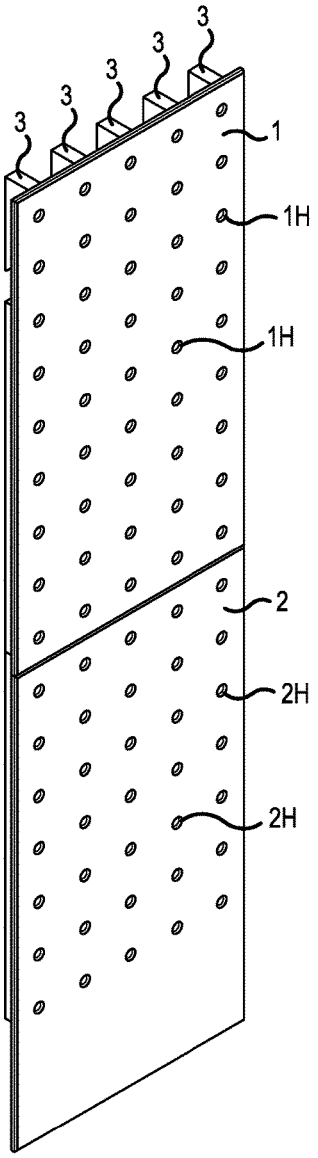
FIG. 1 illustrates a front perspective view of a first embodiment of the present panel assembly, showing the front side of upper and lower panels assembled together.
Figure 2:
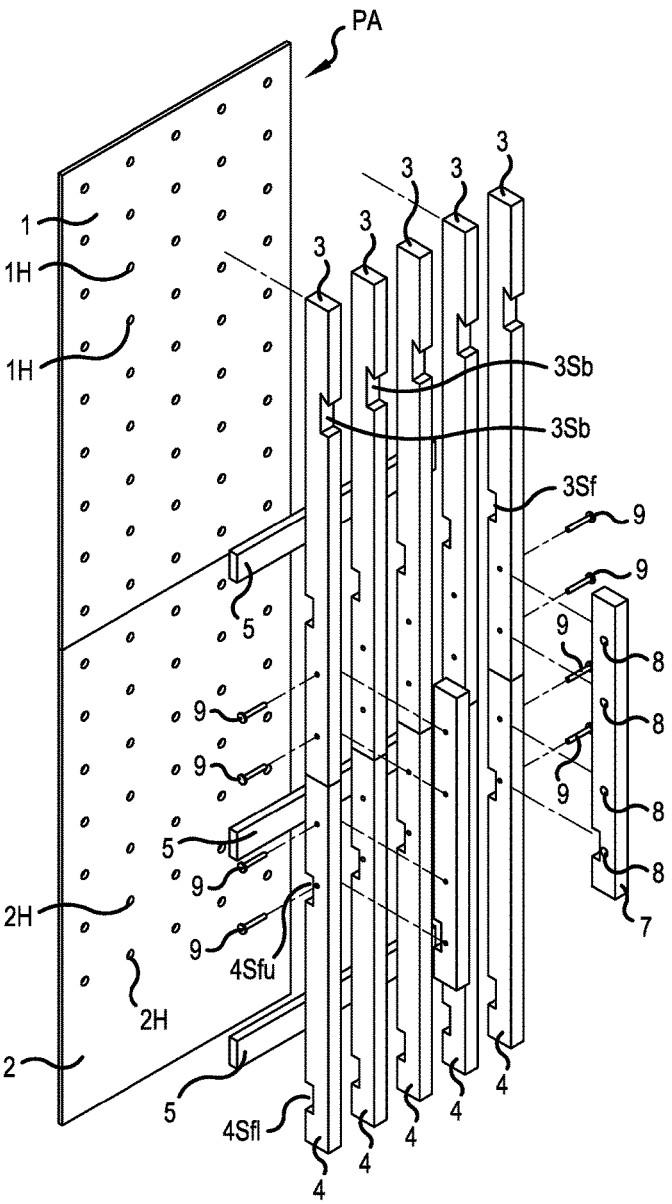
FIG. 2 illustrates the back side of the first embodiment illustrated in FIG. 1, in an exploded view.
Figure 3:
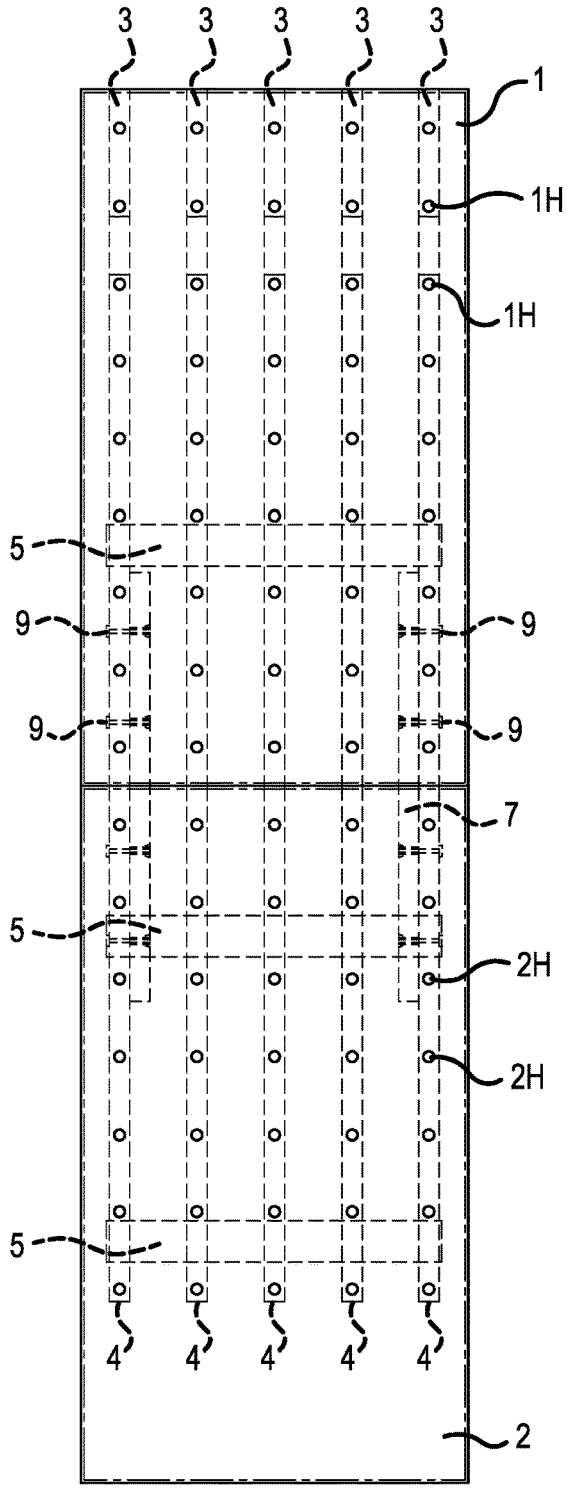
FIG. 3 illustrates the front view of the first embodiment.
Figure 4:
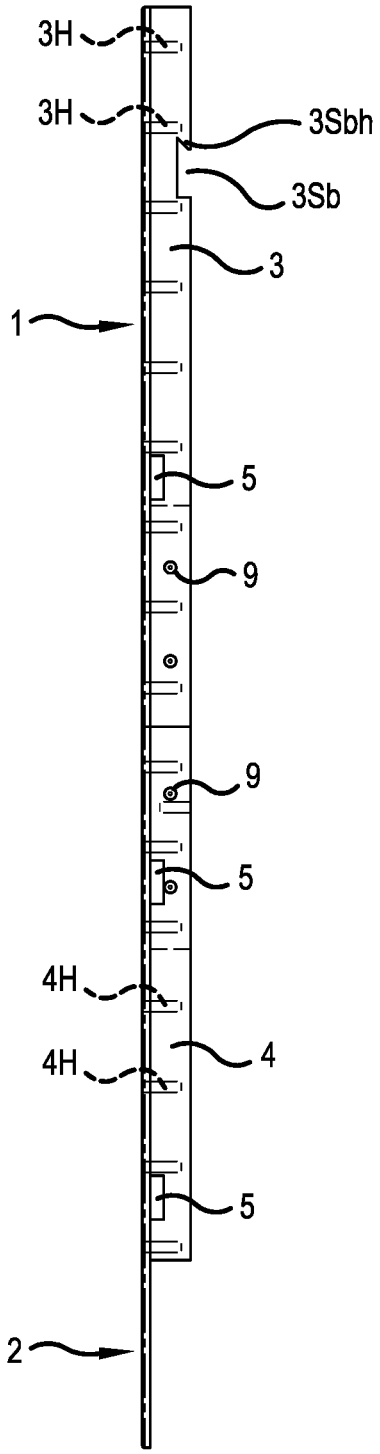
FIG. 4 illustrates the side view of the first embodiment.
Figure 5:
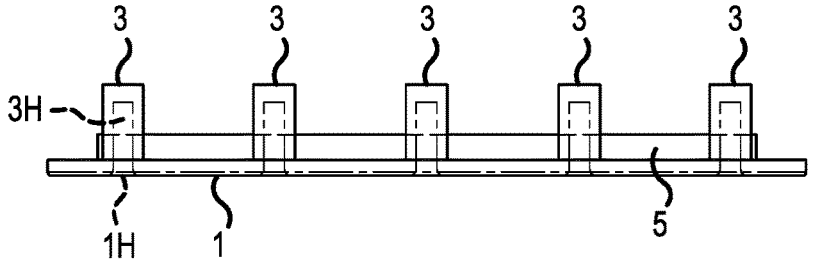
FIG. 5 illustrates the top view of the first embodiment.
Figure 6:
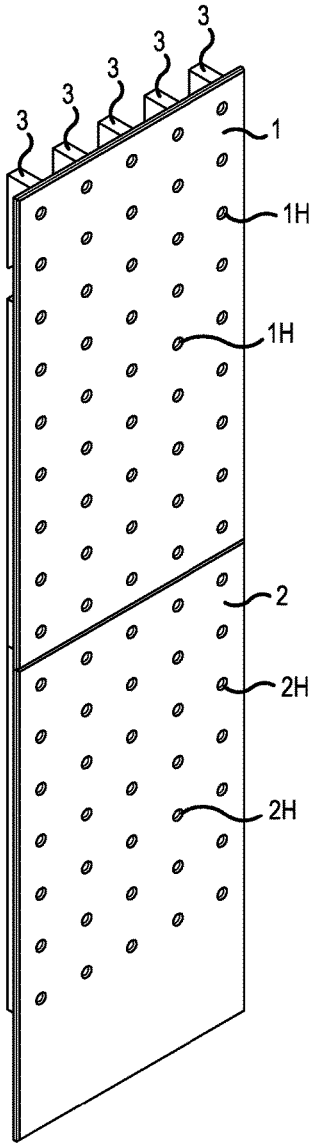
FIG. 6 illustrates a front perspective view of a second embodiment of the present panel assembly.
Figure 7:
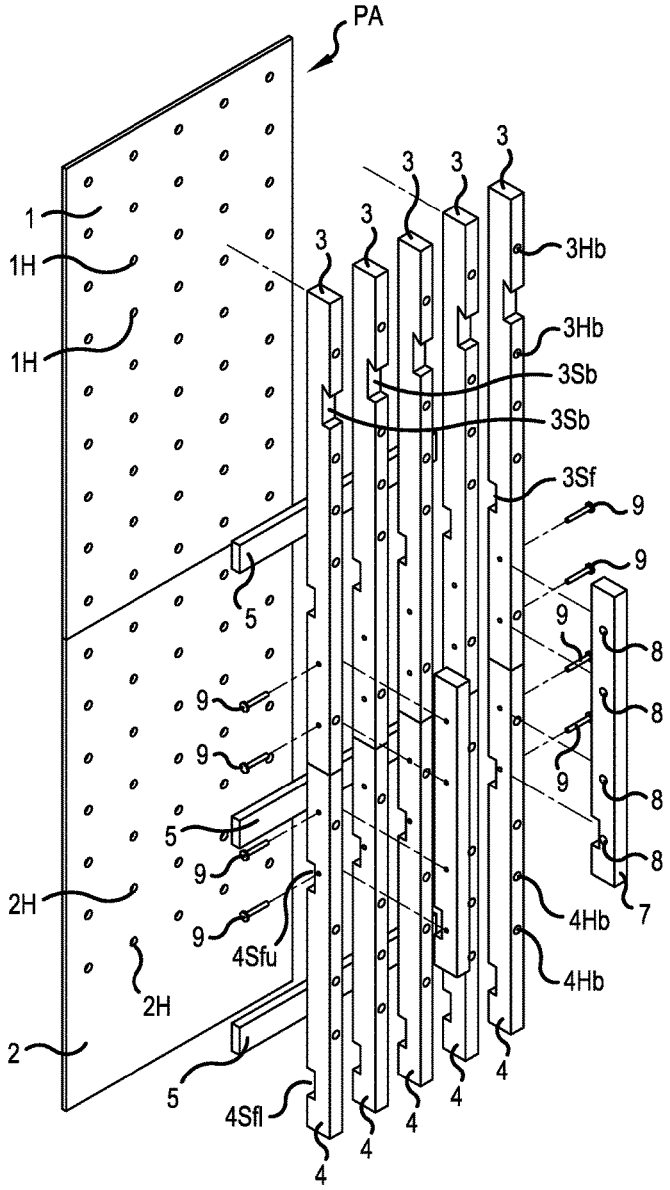
FIG. 7 illustrates an exploded back view of the second embodiment.

Referring to FIGS. 1-2, the upper back support (3, 5) has a front (first) side and a back (second) side opposite the front side. The upper back support is secured to the back side of the upper panel 1 so that the front side of the upper back support confronts the back side of the upper panel 1. Referring to FIGS. 2-3, the upper back support includes, on the front side, a plurality of front (first) blind holes 3H that each align with one of the through holes 1H in the first panel 1. Specifically, the upper back support comprises a plurality of upper (first) vertical beams 3 and at least one (first) horizontal beam 5 (one provided in the illustrated embodiments). The vertical length of each of the upper vertical beams 3 is substantially equal to a vertical length of the first panel 1. The illustrated embodiments show the upper vertical beams 3 being equal in height to the first panel 1.

The horizontal beam 5 has a front (first) side disposed confronting the back side of the upper panel and a back (second) side opposite the front side. The upper vertical beams 3, which are horizontally spaced from each other and parallel to each other, each have a front (first) side disposed confronting the back side of the first panel and a back (second) side opposite the front side thereof. The front and back sides of the upper back support correspond respectively to the front and back sides of the upper vertical beams 3.

Each upper vertical beam 3 has a plurality of vertically spaced front (first) blind holes 3H opening from the one side. The front blind holes 3H in the upper back support correspond to the front blind holes in the upper vertical beams 3.

Each upper vertical beam 3 has, on the front side thereof, a front (first) slot 3Sf sized to receive the horizontal beam 5 and allow the front side of the horizontal beam 5 and the front side of each upper vertical beam 3 to contact the back side of the upper panel 1. The front slots 3Sf confine the horizontal beam 5 from moving in the vertical direction relative to the upper vertical beams 3.

Each upper vertical beam 3 also has, on the back side, a back (second) slot 3Sb vertically spaced above the front slot 3Sa and configured to hook onto an upper portion of the hanging beam HB. The back slot 3Sb can have a French-cleat configuration complementary to the French-cleat configuration of the hanging beam HB to allow the upper vertical beams 3 to be hung from the hanging beam HB. Specifically, as illustrated in FIGS. 2, 4, 7, 9, 11, and 12, the back slot 3Sb at its upper side is angled to form an overhang 3Sbh that engages and sits on the angled upper end of the hanging beam HB. The overhang 3Sbh prevents the upper horizontal beams 3 from drifting out horizontally away from the wall.

Figure 11:
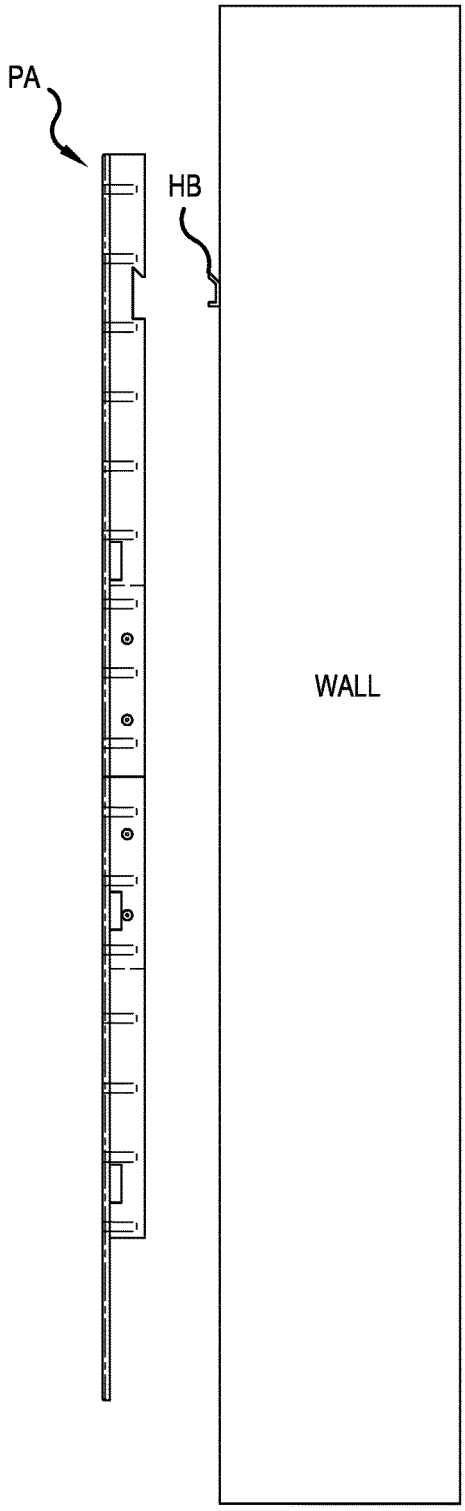
FIG. 11 illustrates the side view the first embodiment (see FIG. 4) disposed next to a wall.

Referring to FIGS. 11-12, the back slots 3Sb are configured to allow the panel assembly PA to positioned so that the overhang 3Sbh can be disposed just above the angled upper end of the hanging beam HB to permit the passage of the hanging beam HB through the back slots 3Sb and allow the back side of the vertical beams 3, 4 to rest on the vertical wall. Dropping the panel assembly PA after resting the back side of the vertical beams 3, 4 on the wall seats the overhang 3Sb, which becomes disposed sandwiched between the wall and the angled upper end. To dismount the panel assembly, the panel assembly PA is first lifted up so that the overhang 3Sb clears the angled upper end of the hanging beam HB to allow the panel assembly to be displaced away from the wall. See FIG. 11. Specifically, the vertical opening width of each back slot 3Sb is larger than the vertical overall width of the hanging beam HB to permit the panel assembly to be lifted up so that the overhang 3Sbh can clear the upper edge of the angled upper end of the hanging beam HB.

The upper horizontal beam 5 and each upper vertical beam 3 can be secured to the back side of the upper panel 1 with an adhesive or glue. The upper horizontal beam 5 and each upper vertical beam 3 also can be secured together with the adhesive or glue. Moreover, the upper horizontal beam 5 and each upper vertical beam 3 can be further secured using screws.

The lower back support is configured similar to the upper back support, except that the lower back support is made shorter and does not include the back slots 3Sb. See FIGS. 3, 4, 8, and 9. Specifically, referring to FIGS. 1-2, the lower back support (4, 5) has a front (first) side and a back (second) side opposite the front side thereof. The lower back support is secured to the back side of the lower panel 2 so that the front side of the lower back support confronts the back side of the lower panel 2. The shorter back support allows for access to power outlets and provides an area for stowing power strips hidden from the view.

Referring to FIGS. 1-2, the lower back support includes, on the front side, a plurality of front (first) blind holes 4H that each align with one of the through holes 2H in the lower panel 2. Specifically, the lower back support comprises a plurality of lower (second) vertical beams 4 and at least one (second, third) horizontal beam 5. The lower vertical beams 4 are used for overall stability of the structure and also lessen any warping of the lower panel 2. The illustrated embodiments also use two (upper and lower) horizontal beams 5 to lessen warping of the panel 2. The vertical length of each lower vertical beam 4 can be substantially shorter than the vertical length of the lower panel 2 as illustrated.

Each horizontal beam 5 has a front (first) side disposed confronting the back side of the lower panel 2 and a back (second) side opposite the front side. The lower vertical beams 4, which are horizontally spaced from each other and parallel to each other, each have a front (first) side disposed confronting the back side of the first panel and a back (second) side opposite the front side thereof. The front and back sides of the lower back support correspond respectively to the front and back sides of the lower vertical beams 4.

Each lower vertical beam 4 has a plurality of vertically spaced front (first) blind holes 4H opening from the front side. The front blind holes 4H in the lower back support correspond to the front blind holes in the lower vertical beams 4.

Each lower vertical beam 4 has, on the front side thereof, upper (second) and lower (third) slot 4Sfu, 4Sfl each sized to receive one of two horizontal beams 5 and allow the front side of the horizontal beams 5 and the front side of each lower vertical beam 4 to contact the back side of the second panel 2.

Each horizontal beam 5 and each lower vertical beam 4 can be secured to the back side of the lower panel 2 with an adhesive or glue. Each horizontal beam 5 and each lower vertical beam 4 can be also secured together with the adhesive or glue. Moreover, each horizontal beam 5 and each upper lower beam 3 can be further secured using screws.

In the illustrated embodiment, the upper vertical beams 3 and the lower vertical beams 4 are aligned vertically. Two linking beams 7 each secure together one of the upper vertical beams 3 and one of the lower vertical beams 4 using fasteners 9, which can be bolts having threaded ends. Specifically, these two linking vertical beams 7 are disposed inwardly from the two upper and lower outermost vertical beams to link together the upper and lower panels 1, 2.

Figure 8:
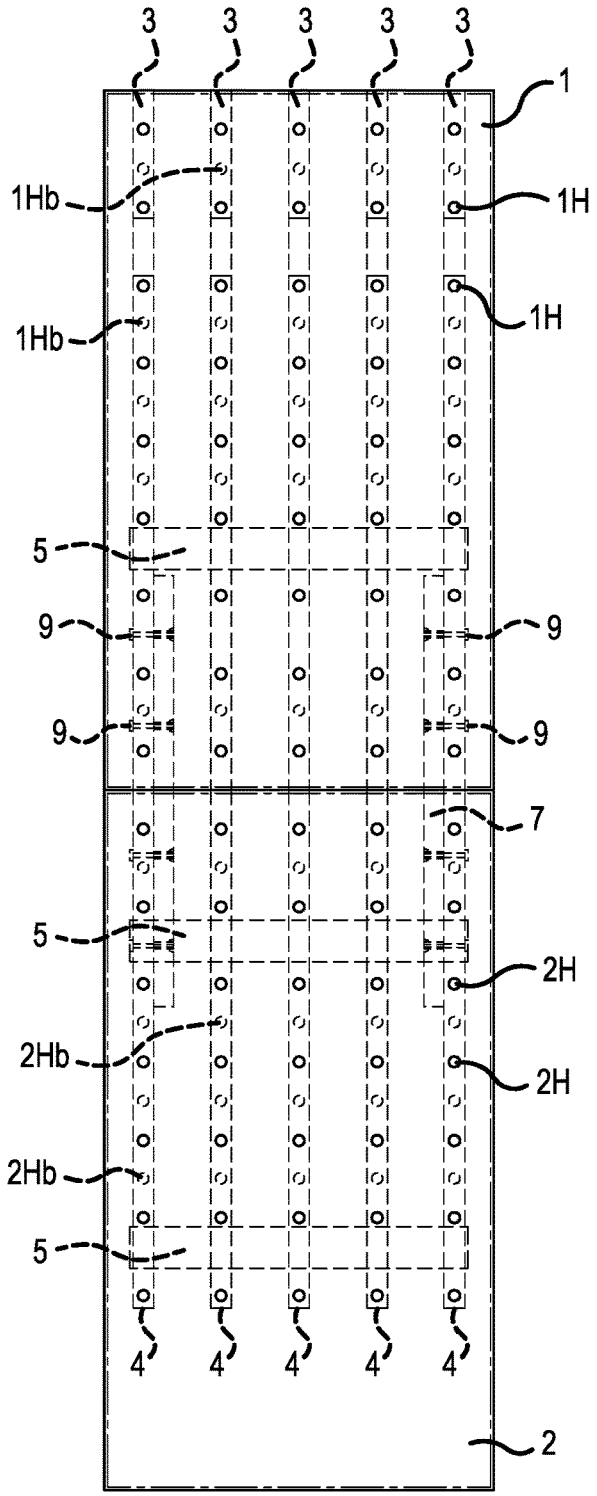
FIG. 8 illustrates the front view of the second embodiment.
Figure 9:
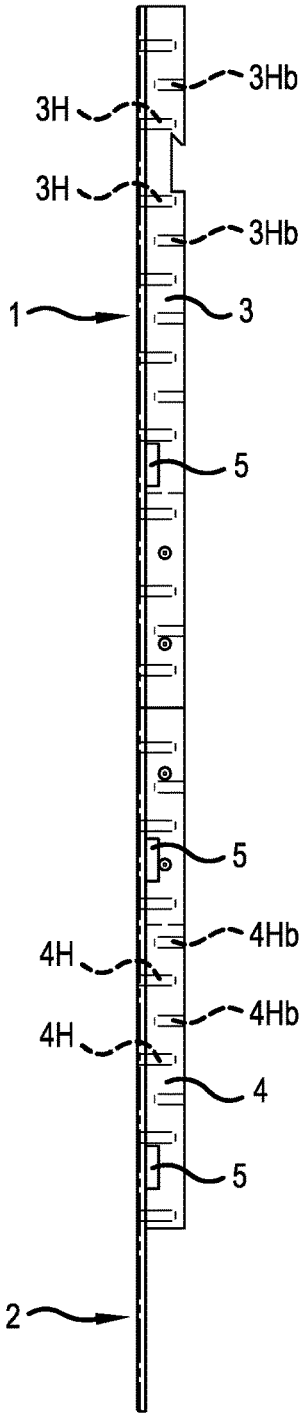
FIG. 9 illustrates the side view of the second embodiment.
Figure 10:
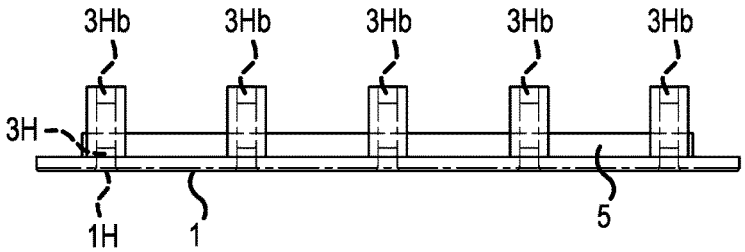
FIG. 10 illustrates the top view of the second embodiment.

Referring to FIGS. 3 and 8, the horizontal beam 5 joined to the upper panel 1 can be disposed near the upper end of the two linking beams 7, as illustrated. The lower horizontal beam 5 joined to the lower panel 2 can be disposed near the bottom end of the lower vertical beams 4, while the upper horizontal beam 5 joined to the lower panel 2 can be disposed at the upper region of the lower vertical beams 4, as illustrated.

Through holes in the two outermost vertical beams 3, 4 can be predrilled to permit passage of fasteners 9. Each linking vertical beam 7 can have threaded nuts 8 in the form of inserts or anchors preinstalled therein from the side opposite the side confronting the outermost vertical beams 3, 4 to receive the threaded end of the bolts to enable the end user to easily assemble and disassemble the panel assembly for portability (transporting) and storage. Although the illustrations only uses two linking vertical beams 7, the number thereof can depend on the size of the panels.

The height of the lower panel 2 can be the same as the upper panel 1, but can have less row of holes 2H than the upper panel 1 (seven rows of holes being provided for the lower panel 2, as opposed to nine rows of holes provided for the upper panel 1 in the illustration).

The second embodiment, as illustrated in FIGS. 6-10, is identical to the first embodiment (FIGS. 1-5), except for the upper and lower vertical beams 3, 4. Specifically, each of the upper and lower vertical beams 3, 4 in the second embodiment includes a set of rear blind holes 3Hb, 4Hb opening from the back sides thereof. That is, in the second embodiment, blind holes are drilled on both the front and the back sides of the upper and lower vertical beams. The front and rear blind holes are offset from each other so that none of the holes are drilled fully through the upper and lower vertical beams.

Figure 18:
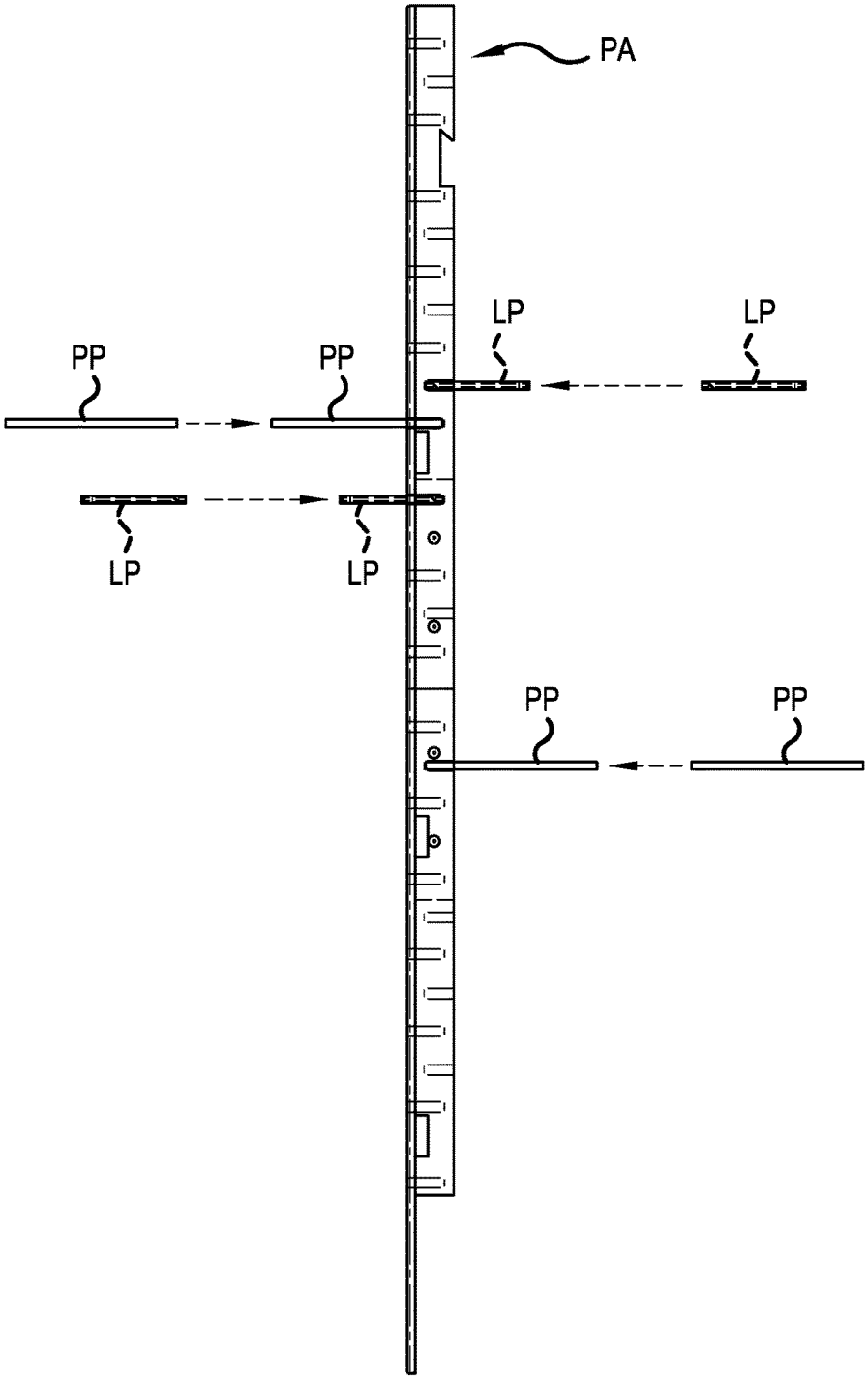
FIG. 18 illustrates the side view of the second embodiment (see FIG. 9) with locking pegs and plain pegs inserted from the front and back sides.

A locking peg LP is securable to any of the front and rear blind holes 3H, 3Hb, 4H, 4Hb in the upper and lower back supports. The through holes 1H, 2H in the upper and lower panel 1, 2 are configured or sized to permit the locking peg to be inserted therethrough to allow the locking peg LP to be secured thereto. Non-locking pegs PP (see FIG. 18), such as a plain dowel, can also be inserted into the blind holes. As seen from FIGS. 1, 2 and 6, 7, the through holes 1H, 2H in the front side thereof can have a larger opening to facilitate insertion of the locking peg LP or non-locking peg PP through any of the through holes 1H, 2H.

Referring to FIGS. 13-17, the locking peg LP includes a wedge 10, a stem 20, which is a hollow rod or tubular member, and a fastener 30, 40. The stem can be cylindrical (as illustrated) or any other shape that is matched to the shape of the holes 1H, 2H, 3H, 3Hb, 4H, 4Hb. The fastener can be a bolt having a threaded shaft 30 and a head 40. In the illustrated embodiment, the head is threaded into the shaft. But a one-piece fastener, namely a bolt having a thread shaft with an integral head, can be used instead. Moreover, the locking peg LP can include a head cover 50 having a protrusion that is forcibly inserted into a hexagonal socket (used for tightening/loosening) formed in the head 40 to cover the head.

The stem 20 has a proximal end 20P at which the bolt enters and a distal end 20D that is angled relative to stem body. The wedge 10 also has a beveled or angled end 10D that is complementarily angled that engages and slides relative to the angled proximal end 20P. The fastener 30, 40, the wedge 10, and the angled proximal end 20P of the stem 20 form a locking mechanism, which is similar in design to a bicycle handlebar stem. The wedge 10 is sized to be inserted into any of the blind holes 3H, 3Hb, 4H, 4Hb and through any of the through holes 1H, 2H or directly thereinto. The fastener is rotated in one (tightening) direction to draw the angled end 10P of the wedge 10 against the angled proximal end 20P of the stem 20. This causes the wedge to slide in relation to the stem 20 in both the radial and axial direction, causing these components to be jammed in the blind hole to secure the locking peg LP therein. The locking peg, when inserted to the blind hole extends outwardly from the front side or the back side. Rotating the fastener 30, 40 in the opposite (loosening) direction moves the wedge 10 and stem 20 away from each other, releasing the locking peg LP from the blind hole.

The rear blind holes 3Hb, 4Hb, in conjunction with multiple locking pegs LP or non-locking pegs PP (having a similar shape as the locking pegs), provide extra rear storage, which can be used as a hidden storage, for exhibit or office installations. See FIG. 18, which illustrates the locking pegs LP and non-locking pegs PP inserted from both the front and back sides.

The vertical beams 3, 4 hold the upper and lower panels 1, 2 spaced from a wall (when the hanging horizontal beam is secured to a wall) and provide the load strength for holding or storing items. Holding the upper and lower panels 1, 2 spaced from the wall also provides a space for running power chords behind the upper and lower panels 1, 2 or inserting sound muting panels between the upper and lower vertical beams. Specifically, the upper and lower vertical beams can have a depth large enough (e.g., 60 mm) to accommodate power strips behind the upper and lower panels 1, 2. As illustrated, the lower vertical beams 4 do not extend the entire height of the lower panel 2 in contrast to the upper vertical beams 3, which extend substantially the entire length of the upper panel 1. This provides a relatively large open area behind the lower panel 2 to allow for stowing one or more power strips and accessing power outlets. See FIG. 12.

Moreover, the panel assembly can be separated into upper and lower panels sized to fit in a vehicle for flat packing or stowing.

Although the panel assembly (less the fasteners) can be made from any suitable material, including plastic and metal, for aesthetic reasons, at least the upper and lower panels are preferably made of wood. Moreover, although the illustrated embodiments show two panels, namely upper and lower panels, additional panel(s) can be stacked. For instance, one or more upper panel with the upper back support can be disposed between the two illustrated upper and lower panels 1, 2, with back supports configured like the upper back support, but without the back slots 3Sb. Moreover, multiple panel assemblies can be hung side-by-side from one or more hanging beams HB.

Given the disclosure of the present invention, one versed in the art would appreciate that there may be other embodiments and modifications within the scope and spirit of the present invention. Accordingly, all modifications attainable by one versed in the art from the present disclosure within the scope and spirit of the present invention are to be included as further embodiments of the present invention. The scope of the present invention accordingly is to be defined as set forth in the appended claims.

What is claimed is:

1. A panel assembly configured to be hangable on a hanging horizontal beam mounted to a structural support and usable with at least one peg to display an object, the panel assembly comprising:

a first panel having a front side and a back side, and a plurality of spaced first through holes extending between the front side and the back side; and a first back support having a first side and a second side opposite the first side thereof, and secured to the first panel, with the first side of the first back support confronting the back side of the first panel, wherein the first back support includes, on the first side thereof, a plurality of first blind holes that each align with one of the plurality of spaced first through holes, wherein the first back support is configured to engage and hang from the hanging horizontal beam, wherein each of the plurality of spaced first through holes is dimensioned to permit one of the at least one peg to pass therethrough, wherein each of the plurality of first blind holes is dimensioned to receive one of the at least one peg inserted through one of the plurality of spaced first through holes, and wherein the first back support comprises:

a plurality of first vertical beams each having a first side disposed confronting the back side of the first panel and a second side opposite the first side thereof, the plurality of first vertical beams being horizontally spaced from each other; and a first horizontal beam having a first side disposed confronting the back side of the first panel and a second side opposite the first side thereof, wherein each of the plurality of first vertical beams has, on the first side thereof, a first slot sized to receive the first horizontal beam and allow the first side of the first horizontal beam and the first sides of the plurality of first vertical beams to contact the back side of the first panel, and wherein each of the plurality of first vertical beams has a plurality of vertically spaced first blind holes opening from the first side thereof, the plurality of first blind holes in the first back support comprising the plurality of vertically spaced first blind holes in the plurality of first vertical beams.

2. The panel assembly according to claim 1, wherein each of the plurality of vertically spaced first blind holes is configured to removably receive one of the at least one peg through a corresponding aligned through hole, among the plurality of spaced first through holes, from the front side of the first panel.

3. The panel assembly according to claim 2, wherein:

at least one of the plurality of first vertical beams has a plurality of vertically spaced second blind holes opening from the second side thereof, and each of the plurality of vertically spaced second blind holes is configured to receive one of the at least one peg inserted from the second side.

4. The panel assembly according to claim 2, further comprising:

a second panel having a front side and a back side, and a plurality of spaced second through holes extending between the front side and the back side of the second panel; and a second back support having a first side and a second side opposite the first side thereof, and secured to of the second panel, with the first side of the second back support confronting the back side of the second panel, wherein the second back support includes, on the first side thereof, a plurality of second blind holes that each align with one of the plurality of spaced second through holes, wherein each of the plurality of second through holes is dimensioned to permit one of the at least one peg to pass therethrough, wherein each of the plurality of second blind holes is dimensioned to receive one of the at least one peg, inserted through one of the plurality of spaced second through holes, wherein the second panel is disposed below the first panel, and wherein the plurality of spaced first through holes and the plurality of spaced second through holes are arrayed.

5. The panel assembly according to claim 4, wherein the second back support comprises:

a plurality of second vertical beams each having a first side disposed confronting the back side of the second panel and a second side opposite the first side thereof, the plurality of second vertical beams being horizontally spaced from each other; and a second horizontal beam having a first side disposed confronting the back side of the second panel and a second side opposite the first side thereof, wherein each of the plurality of second vertical beams has, on the first side thereof, a second slot sized to receive the second horizontal beam and allow the first side of the second horizontal beam and the first sides of the plurality of second vertical beams to contact the back side of the second panel, and wherein each of the plurality of second vertical beams has a plurality of vertically spaced second blind holes opening from the first side thereof, the plurality of second blind holes in the second back support comprising the plurality of vertically spaced second blind holes in the plurality of second vertical beams.

6. The panel assembly according to claim 5, wherein the second back support further includes:

a third horizontal beam having a first side disposed confronting the back side of the second panel and a second side opposite the first side thereof, wherein each of the plurality of second vertical beams has a third slot vertically spaced from the second slot and sized to receive the third horizontal beam and allow the first side of the third horizontal beam and the first sides of the plurality of second vertical beams to contact the back side of the second panel.

7. The panel assembly according to claim 6, further including:

a first linking beam that secures together one of the plurality of first vertical beams and one of the plurality of second vertical beams; and a second linking beam that secures together another of the plurality of first vertical beams and another of the plurality of second vertical beams, wherein the first and second linking beams secure the first and second back supports together.

8. A panel system comprising:

a hanging horizontal beam configured to be mountable to a structural support;

at least one peg; and a panel assembly configured to be hangable on the hanging horizontal beam and comprising:

a first panel having a front side and a back side, and a plurality of spaced first through holes extending between the front side and the back side; and a first back support having a first side and a second side opposite the first side thereof, and secured to the first panel, with the first side of the first back support confronting the back side of the first panel, wherein the first back support includes, on the first side thereof, a plurality of first blind holes that each align with one of the plurality of spaced first through holes, wherein one peg, among the at least one peg, is securable to the first back support, wherein the one peg has a locking mechanism at one end and is configured to extend through a first through hole, among the plurality of spaced first through holes, and extend into and secure to a first blind hole, among the plurality of first blind holes, aligned with the first through hole, wherein each of the at least one peg is configured to extend outwardly from the front side of the first panel when received in the first blind hole, and wherein the first back support comprises:

a plurality of first vertical beams each having a first side disposed confronting the back side of the first panel and a second side opposite the first side thereof, the plurality of first vertical beams being horizontally spaced from each other; and a first horizontal beam having a first side disposed confronting the back side of the first panel and a second side opposite the first side thereof, wherein each of the plurality of first vertical beams has, on the first side thereof, a first slot sized to receive the first horizontal beam and allow the first side of the first horizontal beam and the first sides of the plurality of first vertical beams to contact the back side of the first panel, and wherein each of the plurality of first vertical beams has a plurality of vertically spaced first blind holes opening from the first side thereof, the plurality of first blind holes in the first back support comprising the plurality of vertically spaced blind holes in the plurality of first vertical beams.

9. The panel system according to claim 8, wherein each of the plurality of vertically spaced first blind holes is configured to removably receive one of the at least one peg through a corresponding aligned through hole, among the plurality of spaced first through holes.

10. The panel system according to claim 9, wherein:

at least one of the plurality of first vertical beams has a plurality of vertically spaced second blind holes opening from the second side thereof, and each of the plurality of vertically spaced second blind holes is configured to receive any one of the at least one peg inserted from the second side.

11. The panel system according to claim 9, further comprising:

a second panel having a front side and a back side, and a plurality of spaced second through holes extending between the front side and the back side of the second panel; and a second back support having a first side and a second side opposite the first side thereof, and secured to the second panel, with the first side of the second back support confronting the back side of the second panel, wherein the second back support includes, on the first side thereof, a plurality of second blind holes that each align with one of the plurality of spaced second through holes, wherein each of the at least one peg is extendable through a second through hole, among the plurality of spaced second through holes, and extend into a second blind hole, among the plurality of second blind holes, aligned with the second through hole, wherein the second panel is disposed below the first panel, and wherein the plurality of spaced first through holes and the plurality of spaced second through holes are arrayed.

12. The panel system according to claim 11, wherein the second back support comprises:

a plurality of second vertical beams each having a first side disposed confronting the back side of the second panel and a second side opposite the first side thereof, the plurality of second vertical beams being horizontally spaced from each other; and a second horizontal beam having a first side disposed confronting the back side of the second panel and a second side opposite the first side thereof, wherein each of the plurality of second vertical beams has, on the first side thereof, a second slot sized to receive the second horizontal beam and allow the first side of the second horizontal beam and the first sides of the plurality of second vertical beams to contact the back side of the second panel, and wherein each of the plurality of second vertical beams has a plurality of vertically spaced second blind holes opening from the first side thereof, the plurality of second blind holes in the second back support comprising the plurality of vertically spaced second blind holes in the plurality of second vertical beams.

13. The panel system according to claim 12, wherein each of the plurality of first vertical beams has, on the second side, a second slot configured to hook onto an upper portion of the hanging horizontal beam.

14. The panel system according to claim 13, further including:

a third horizontal beam having a first side disposed confronting the back side of the second panel and a second side opposite the first side thereof, wherein each of the plurality of second vertical beams has a third slot vertically spaced from the second slot and sized to receive the third horizontal beam and allow the first side of the third horizontal beam and the first sides of the plurality of second vertical beams to contact the back side of the second panel.

15. The panel system according to claim 14, further including:

a first linking beam that secures together one of the plurality of first vertical beams and one of the plurality of second vertical beams; and a second linking beam that secures together another of the plurality of first vertical beams and another of the plurality of second vertical beams, wherein the first and second linking beams secure the first and second back supports together.

16. The panel system according to claim 15, further comprising a plurality of fasteners securing the first linking beam to the one first vertical beam and the one second vertical beam, and the second linking beam to the another first vertical beam and the another second vertical beam.

17. The panel system according to claim 16, wherein:

a vertical length of each of the plurality of first vertical beams is substantially equal to a vertical length of the first panel, and a vertical length of each of the plurality of second vertical beams is substantially shorter than a vertical length of the second panel.

18. The panel system according to claim 17, wherein:

each of the first horizontal beam and the plurality of the first vertical beams is secured to the back side of the first panel with an adhesive, the first horizontal beam and the plurality of the first vertical beams are secured together with the adhesive, each of the second and third horizontal beams and the plurality of the second vertical beams is secured to the back side of the second panel with the adhesive, and the second and third horizontal beams and the plurality of the second vertical beams are secured together with the adhesive.

19. A panel system comprising:

a hanging horizontal beam configured to be mountable to a structural support;

at least one peg; and a panel assembly configured to be hangable on the hanging horizontal beam and comprising:

a first panel having a front side and a back side, and a plurality of spaced first through holes extending between the front side and the back side; and a first back support having a first side and a second side opposite the first side thereof, and secured to the first panel, with the first side of the first back support confronting the back side of the first panel, wherein the first back support includes, on the first side thereof, a plurality of first blind holes that each align with one of the plurality of spaced first through holes, wherein one peg, among the at least one peg, is securable to the first back support, wherein the one peg has a locking mechanism at one end and is configured to extend through a first through hole, among the plurality of spaced first through holes, and extend into and secure to a first blind hole, among the plurality of first blind holes, aligned with the first through hole, wherein each of the at least one peg is configured to extend outwardly from the front side of the first panel when received in the first blind hole, and wherein the one peg having the locking mechanism comprises:

a bolt with a threaded shaft;

a tubular member having a first end and a second end; and a wedge configured to be engageable with the second end of the tubular member and having a threading configured to receive the thread shaft inserted into the tubular member from the first end, wherein drawing the wedge against the second end of the tubular member by rotating the bolt rotating in one direction secures the one peg to the first blind hole in the first back support.

20. A method of assembling and hanging a panel assembly comprising:

a first panel having a front side and a back side, and a plurality of spaced first through holes extending between the front side and the back side;

a first back support having a first side and a second side opposite the first side thereof, and secured to the first panel, with the first side of the first back support confronting the back side of the first panel;

a second panel having a front side and a back side, and a plurality of spaced second through holes extending between the front side and the back side of the second panel;

a second back support having a first side and a second side opposite the first side thereof, and secured to the second panel, with the first side of the second back support confronting the back side of the second panel, wherein the first back support includes, on the first side thereof, a plurality of first blind holes that each align with one of the plurality of spaced first through holes, wherein the second back support includes, on the first side thereof, a plurality of second blind holes that each align with one of the plurality of spaced second through holes, wherein each of the plurality of first and second blind holes is configured to receive one of a plurality of pegs extending through the respective one of the plurality of first and second through holes, from the front side of the first or second panel, and wherein each of the plurality of first blind holes is configured to removably receive one of the plurality of pegs through a corresponding aligned through hole, among the plurality of spaced first and second through holes, from the front side of the first or second panel, wherein the first back support comprises:

a plurality of first vertical beams each having a first side disposed confronting the back side of the first panel and a second side opposite the first side thereof, the plurality of first vertical beams being horizontally spaced from each other; and a first horizontal beam having a first side disposed confronting the back side of the first panel and a second side opposite the first side thereof, wherein each of the plurality of first vertical beams has, on the first side thereof, a first slot sized to receive the first horizontal beam and allow the first side of the first horizontal beam and the first sides of the plurality of first vertical beams to contact the back side of the first panel, and wherein each of the plurality of first vertical beams has a plurality of vertically spaced first blind holes opening from the first side thereof, the plurality of first blind holes in the first back support comprising the plurality of vertically spaced blind holes in the plurality of first vertical beams, and wherein the method comprises the steps of:

providing first and second linking beams;

providing a hanging horizontal beam;

mounting the hanging horizontal beam to a structural support;

securing together the first and second back supports using the first and second linking beams;

hanging the assembled panel assembly on the hanging horizontal beam.

* * * * *